US010696003B2

(12) United States Patent
Robadey

(10) Patent No.: US 10,696,003 B2
(45) Date of Patent: Jun. 30, 2020

(54) TOOL-HOLDER HEAD, TRANSPORT CARRIAGE AND METHODS FOR MOUNTING AND REMOVING A TOOL FOR A UNIT FOR CONVERTING A FLAT SUBSTRATE

(71) Applicant: BOBST MEX SA, Mex (CH)

(72) Inventor: Pierre Robadey, St-Sulpice (CH)

(73) Assignee: BOBST MEX SA (CH)

( * ) Notice: Subject to any disclaimer, the term of this patent is extended or adjusted under 35 U.S.C. 154(b) by 454 days.

(21) Appl. No.: 15/531,521

(22) PCT Filed: Nov. 26, 2015

(86) PCT No.: PCT/EP2015/025090
§ 371 (c)(1),
(2) Date: May 30, 2017

(87) PCT Pub. No.: WO2016/087050
PCT Pub. Date: Jun. 9, 2016

(65) Prior Publication Data

US 2018/0290417 A1 Oct. 11, 2018

(30) Foreign Application Priority Data

Dec. 4, 2014 (EP) ..... 14020102

(51) Int. Cl.
*B31F 1/07* (2006.01)

(52) U.S. Cl.
CPC ..... *B31F 1/07* (2013.01); *B31F 2201/0753* (2013.01); *B31F 2201/0776* (2013.01)

(58) Field of Classification Search
CPC ..... B31F 1/07; B31F 2201/0753; B31F 2201/0776
USPC ..... 414/619, 620, 621, 622, 623
See application file for complete search history.

(56) References Cited

U.S. PATENT DOCUMENTS 2,792,781 A * 5/1957 Kaldschmidt ..... B41F 9/18 101/216
3,174,724 A * 3/1965 Verlik ..... B41F 9/18 254/133 R
3,323,345 A * 6/1967 Lyle ..... B21B 31/103 72/239
3,384,012 A * 5/1968 Zernov ..... B41F 9/18 101/216

(Continued)

FOREIGN PATENT DOCUMENTS

DE 102 12 172 A1 9/2002
EP 0 858 948 A1 8/1998

(Continued)

OTHER PUBLICATIONS

International Search Report dated Feb. 24, 2016 in corresponding PCT International Application No. PCT/EP2015/025090.

(Continued)

*Primary Examiner* — Jason L Vaughan
(74) *Attorney, Agent, or Firm* — Ostrolenk Faber LLP

(57) ABSTRACT

A tool-holder head for a carriage for transporting rotary tools of a unit for converting a flat substrate, which includes an upper port (29) and a lower port (30) arranged one above the other and intended to receive a front end of an upper rotary tool (10) and a front end of a lower rotary tool (11), respectively.

12 Claims, 6 Drawing Sheets

(56) References Cited

U.S. PATENT DOCUMENTS 3,404,794 A * 10/1968 Wilson ..... A47F 7/175 414/621
3,491,570 A * 1/1970 Beard ..... B21B 31/103 72/239
3,559,441 A * 2/1971 Lemper et al. ..... B21B 31/08 72/239
3,625,145 A * 12/1971 Heatley, Jr. ..... B41F 9/00 101/142
3,638,468 A * 2/1972 Fukui ..... B21B 31/103 72/238
3,734,328 A * 5/1973 Dalglish ..... B21C 47/242 414/620
3,738,142 A * 6/1973 Adair ..... B21B 31/103 72/239
3,747,387 A * 7/1973 Shumaker ..... B21B 31/10 72/239
3,779,061 A * 12/1973 Shumaker ..... B21B 31/103 72/239
3,783,782 A * 1/1974 Hardt ..... B41F 9/18 101/216
3,789,757 A * 2/1974 Motter ..... B41F 9/18 101/153
3,866,455 A * 2/1975 Petros ..... B21B 31/103 72/239
3,876,087 A * 4/1975 Osta ..... B41F 9/18 414/349
3,926,027 A * 12/1975 Krumme ..... B21B 31/103 72/239
3,979,939 A * 9/1976 Pazderka ..... B21B 31/103 72/239
4,056,207 A 11/1977 Spilker ..... 214/652
4,074,558 A * 2/1978 Pim ..... B21B 31/103 72/239
4,137,843 A * 2/1979 Ottenhue ..... B41F 9/18 101/153
4,199,289 A * 4/1980 Segbert ..... B41F 13/00 101/167
4,413,541 A * 11/1983 Biggar, III ..... B23D 35/008 101/153
4,823,693 A * 4/1989 Kobler ..... B41F 13/20 101/218
4,988,252 A * 1/1991 Yamamoto ..... B65H 67/065 242/474
4,989,514 A * 2/1991 Schiavi ..... B41F 5/24 101/216
5,031,297 A * 7/1991 Nelson ..... B23P 11/022 29/234
5,142,978 A * 9/1992 Borel ..... B41F 13/44 101/177
5,150,514 A * 9/1992 Seki ..... B21B 31/08 29/824
5,274,984 A * 1/1994 Fukuda ..... B65B 9/20 242/559.3
5,275,105 A * 1/1994 Schweizer ..... B41F 13/34 101/477
5,282,418 A * 2/1994 Uera ..... B41F 31/30 101/216
5,549,044 A * 8/1996 Achelpohl ..... B41F 13/24 101/216
5,618,152 A * 4/1997 Andrews ..... B41F 9/18 414/546
5,660,068 A * 8/1997 Yamamoto ..... B21D 3/05 72/164
5,715,749 A * 2/1998 Miller ..... B41F 13/24 101/216
6,038,972 A * 3/2000 Delwiche ..... B41F 5/24 101/216
6,238,198 B1 * 5/2001 Hatasa ..... B31F 1/2868 156/462
6,648,580 B2 * 11/2003 Lofgren ..... B21C 47/242 414/607
6,692,210 B1 * 2/2004 Ettelbruck ..... B41F 9/18 414/222.01
6,918,338 B2 * 7/2005 Thiessen ..... B41J 2/0057 101/178
6,918,732 B2 * 7/2005 Jendroska ..... B41F 13/00 414/331.11
7,040,229 B2 * 5/2006 Bazin ..... B41F 5/24 101/483
7,117,789 B2 * 10/2006 Bazin ..... B41F 5/24 101/153
7,117,793 B2 * 10/2006 Petersen ..... B41F 13/0016 101/477
7,290,488 B2 * 11/2007 Petersen ..... B41F 27/105 101/375
7,370,581 B2 * 5/2008 Plasswich ..... B41F 13/00 101/216
7,409,909 B2 * 8/2008 Plaßwich ..... B41F 13/0016 101/479
7,543,531 B2 * 6/2009 Blanchard ..... B41F 27/105 101/216
7,748,317 B2 * 7/2010 Puig Vila ..... B41F 27/1206 101/216
8,141,239 B2 * 3/2012 Rogge ..... B41F 13/00 101/477
9,056,451 B2 * 6/2015 Rogge ..... B41F 13/0016
2002/0129720 A1 * 9/2002 Jendroska ..... B41F 13/00 101/216
2006/0162600 A1 * 7/2006 Plasswich ..... B41F 13/0016 101/485
2008/0134919 A1 * 6/2008 Jendroska ..... B41F 13/00 101/479
2009/0028613 A1 * 1/2009 Plasswich ..... B41F 27/105 399/297

FOREIGN PATENT DOCUMENTS

EP 1 598 275 A1 11/2005
EP 1 652 661 A2 5/2006
WO WO 2007/113660 A2 10/2007

OTHER PUBLICATIONS

Written Opinion dated Feb. 24, 2016 in corresponding PCT International Application No. PCT/EP2015/025090.

* cited by examiner

TOOL-HOLDER HEAD, TRANSPORT CARRIAGE AND METHODS FOR MOUNTING AND REMOVING A TOOL FOR A UNIT FOR CONVERTING A FLAT SUBSTRATE

CROSS-REFERENCE TO RELATED APPLICATION

The present application is a 35 U.S.C. §§ 371 national phase conversion of PCT/EP2015/025090, filed Nov. 26, 2015, which claims priority of European Patent Application No. 14020102.1, filed Dec. 4, 2014, the contents of all of which are incorporated herein by reference. The PCT International Application was published in the French language.

FIELD OF THE INVENTION

The present invention relates to a tool-holder head, intended for a carriage for transporting rotary tools, for a unit for converting a flat substrate. The invention relates to a transport carriage provided with a tool-holder head for a unit for converting a flat substrate. The invention also relates to a method for mounting a tool in a unit for converting a flat substrate and to a method for removing a tool from a unit for converting a flat substrate

BACKGROUND

A machine for converting a substrate is intended for the production of packaging. In this machine, an initial flat substrate, such as a continuous web of cardboard, is unrolled and printed on by a printing station comprising one or more printer units. The flat substrate is then transferred into an introduction unit and then into an embossing unit, possibly followed by a scoring unit. The flat substrate is then cut in a cutting unit. After ejection of the scrap areas, the preforms obtained are sectioned in order to obtain individual boxes.

A rotary conversion unit may be an embossing unit, a scoring unit, a cutting unit, a scrap-ejection unit, or a printer unit. Each rotary conversion unit comprises a cylindrical upper conversion tool and a cylindrical lower conversion tool, between which the flat substrate passes in order to be converted. In operation, the rotary conversion tools rotate at the same speed but in opposite directions to one another. The flat substrate passes through the gap situated between the rotary tools, which form a relief by embossing, form a relief by scoring, cut the flat substrate into preforms by rotary cutting, eject the scrap, or print a pattern during printing.

The cylinder changing operations have been found to be time-consuming and tedious. The operator must mechanically disconnect the cylinder in order to remove the cylinder from its drive mechanism. Then, the operator must extract the cylinder from the conversion machine and fit the new cylinder in the conversion machine by reconnecting the cylinder to its drive. The weight of a cylinder is high, around 50 kg to 2000 kg. In order to extract the cylinder, the operator must lift the cylinder with the aid of a hoist.

Because of its fairly high weight, a cylinder cannot be changed very quickly. Moreover, numerous tool changes may be necessary to obtain a very large number of boxes that are different from one another. These tools have to be ordered a long time in advance, which is becoming incompatible with the production changes that are currently required. In addition, tools are relatively expensive to produce and only become cost-effective with an extremely large output.

Therefore, some conversion units have rotary tools made up of a mandrel and a removable sleeve carrying the form for carrying out the conversion that is able to be fitted on the mandrel. All that is necessary is to change the sleeve rather than the entire rotary tool. This makes it easier to change the tool because of the low weight of the sleeve and reduces costs since the sleeve is less expensive. The mandrel can also be changed and is chosen depending on its diameter.

However, the operations of loading and exchanging rotary tools in the conversion units remain tricky for operators, notably because of the mounting precision demanded in the unit and of the high weight of these tools. Therefore, packaging producers are nowadays seeking to make it easier to move rotary tools toward or away from the conversion units, such that they can be changed quickly and in a reproducible and simple manner.

SUMMARY OF THE INVENTION

An aim of the present invention is to propose devices and methods which at least partially solve the drawbacks of the prior art.

To this end, a subject of the present invention is a tool-holder head for a carriage for transporting rotary tools of a unit for converting a flat substrate. The tool-holder head comprises an upper port and a lower port. The upper port and the lower port are arranged one above the other and are intended to receive a front end of an upper rotary tool and a front end of a lower rotary tool, respectively.

A further subject of the invention is a tool-holder head for a carriage for transporting rotary tools of a unit for converting a flat substrate. The transport carriage is equipped with a mobile base. The tool-holder head comprises at least one port that is intended to receive a front end of a rotary tool and is positioned in a cantilevered manner with respect to the mobile base so that the rotary tool can be passed into the conversion unit.

A tool is defined as being a mandrel, a mandrel and sleeve assembly, a one-piece tool, or the like. The conversion unit is defined as being a scoring unit, an embossing unit, a rotary cutting unit, a scrap ejection unit, a printer unit, chosen on its own or in combination, or the like.

The arrangement of the parallel tools at a predetermined spacing in the transport carriage allows them to be transferred without additional manipulations of the rotary tools already prepositioned in the region of the bearings of the conversion unit. The tool-holder head thus makes it possible to arrange the rotary tool(s) such that the rotary tool(s) can be easily mounted in/removed from the conversion unit. Therefore, the risks of collision between the rotary tools but also between the rotary tools and the conversion unit are reduced. The positioning of the rotary tools along the axis of the bearings of the conversion unit is also rendered easier. Furthermore, the number of operations is reduced and the handling of the heavy rotary tools is rendered easier.

According to one exemplary embodiment, the tool-holder head comprises a holding interface that is intended to engage with a turret of the conversion unit in order to fix the tool-holder head to the turret. The fixing of the transport carriage to the conversion unit makes it possible for the conversion unit to reference the precise position of the rotary tools.

The holding interface is configured, for example, to hang the tool-holder head on the turret of the conversion unit. The fixing of the tool-holder head on the turret by hanging is ergonomic, notably on account of the use of a lifting device of the transport carriage that is configured to raise or lower the tool-holder head with respect to the mobile base of the transport carriage.

For example, the holding interface comprises at least one first attachment member that is intended to engage with at least one complementary first attachment member of the turret. The first attachment members allow the tool-holder head to be guided up to and fixed on the conversion unit, notably by avoiding movements of the tool-holder head in the transverse direction, along the axis of rotation of the rotary tools.

The first attachment members comprise, for example, at least one first hook that is able to engage with a first roller mounted so as to rotate freely. The rollers make it easier to mount the tool-holder head on, and remove the tool-holder head from, the turret, limiting the risks of jamming.

For example, the holding interface comprises at least one first shoulder that is intended to engage with a support block of the turret for carrying the tool-holder head, such that when the tool-holder head is carried by the support block, the first hooks are disposed substantially above the first rollers. This makes it possible for the tool-holder head not to rest on the first rollers but for most of the weight of the rotary tools to be absorbed by the support blocks of the turret. The support blocks thus make it possible to relieve the first rollers of the weight of the rotary tools that are substantially more fragile. The support abutments, fixed to the turret, form the vertical reference.

For example, the holding interface comprises at least one guide slot that is intended to engage with a complementary guide pin carried by the turret, the guide slot being L-shaped with a smaller thickness than the openings of the first hooks. The slot and the guide pin make it possible to guide the docking of the tool-holder head on the turret. The guide pin, which is more robust than the rollers, therefore allows the tool-holder head to be guided in the direction along the axis of rotation of the rotary tools and then vertically, following the L-shaped path of the guide slots, avoiding possible collisions between the hook(s) of the tool holder and the rollers of the turret.

According to one exemplary embodiment, the tool-holder head comprises a second front holding interface that is intended to engage with a mobile base of the transport carriage in order to fix the tool-holder head to the mobile base. The tool-holder head is thus removable, such that the mobile base can be the same for different tool-holder heads.

For example, the second holding interface is configured to hang the tool-holder head on the mobile base.

For example, the second holding interface comprises at least one second attachment member that is intended to engage with at least one complementary second attachment member of the mobile base, the second attachment members comprising at least one second hook that is able to engage with a second roller mounted so as to rotate freely. The rollers make it easier to mount the tool-holder head on and remove it from the mobile base, limiting the risks of jamming.

For example, the second holding interface comprises at least one second shoulder that is intended to engage with a support block of the mobile base for carrying the tool-holder head, such that when the tool-holder head is carried by the support block, the second hooks are disposed substantially above the second rollers.

According to one exemplary embodiment, the tool-holder head comprises a locking device configured to take up an unlocked position or a locking position in which the locking device locks the holding of the front end of the tool in the upper and lower ports.

According to one exemplary embodiment, the locking device comprises an articulated system, an upper locking pin, a lower locking pin and an actuating lever that is connected to the upper and lower locking pins by the articulated system such that the actuation of the lever positions the locking pins in the unlocked position or the locking position.

According to one exemplary embodiment, the upper and lower ports comprise a respective resilient device that is intended to bear against the front end of the tool and is able to be pushed back by the latter toward the end wall of the housing of the upper or lower port. Collisions of the tools are thus avoided with the tool-holder head in the unlocked position by manipulation of the tools at the rear ends by the gripper of the motorized drive means, on the opposite side from the driver. The rear end of the tool is against the end side of the gripper of the drive means.

A further subject of the invention is a transport carriage comprising a leg provided with rolling elements, a tool-holder head as described and claimed below and a lifting device configured to raise or lower the tool-holder head with respect to the leg. The lifting device thus makes it possible to lift and lower significant loads such as the rotary tool elements for hanging the tool-holder head on the turret of the conversion unit but also makes it possible to make the handling of the transport carriage in the factory safer by lowering the center of gravity of the load. Specifically, the lowering of loads while the rotary tools are being conveyed in the factory makes it possible to avoid a situation in which the transport carriage is unbalanced by the cantilevered rotary tools.

A further subject of the invention is a method for mounting a tool in a conversion unit by means of a transport carriage as described and claimed below. The method for mounting a tool comprises the following steps of:

- passing the transport carriage into the conversion unit,
- fixing the tool-holder head, provided with a tool, of the transport carriage to a turret of the conversion unit,
- locking a rear end of the tool,
- unlocking a front end of the tool from the port of the tool-holder head,
- disconnecting the tool-holder head from the turret,
- extracting the transport carriage from the conversion unit, and
- fitting the front bearings on the ends of the tool.

A further subject of the invention is a method for removing a tool from a conversion unit by means of a transport carriage as described and claimed below. The method for removing a tool comprises the following steps of:

- passing the transport carriage into the conversion unit,
- fixing the tool-holder head, not provided with a tool, of the transport carriage to a turret of the conversion unit,
- locking a front end of the tool to the port of the tool-holder head,
- unlocking a rear end of the tool,
- disconnecting the tool-holder head from the turret, and
- extracting the transport carriage provided with the tool from the conversion unit.

BRIEF DESCRIPTION OF THE DRAWINGS

Further advantages and features will become apparent from reading the description of the invention and from the appended figures, which show a nonlimiting exemplary embodiment of the invention and in which.

Figure 2:
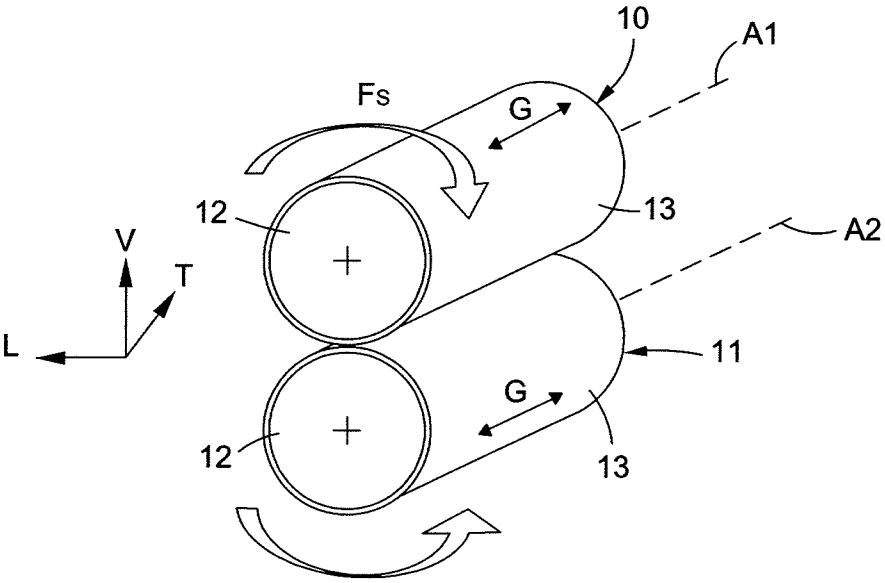
FIG. 2 shows a perspective view of an upper rotary tool and of a lower rotary tool.

The longitudinal, vertical and transverse directions indicated in FIG. 2 are defined by the trihedron L, V, T. The transverse direction T is the direction perpendicular to the longitudinal direction of movement L of the flat substrate. The horizontal plane corresponds to the plane L, T. The front and rear positions are defined with respect to the transverse direction T as being on the side of the driver and on the opposite side from the driver, respectively.

DETAILED DESCRIPTION OF THE PREFERRED EMBODIMENTS

Figure 1:
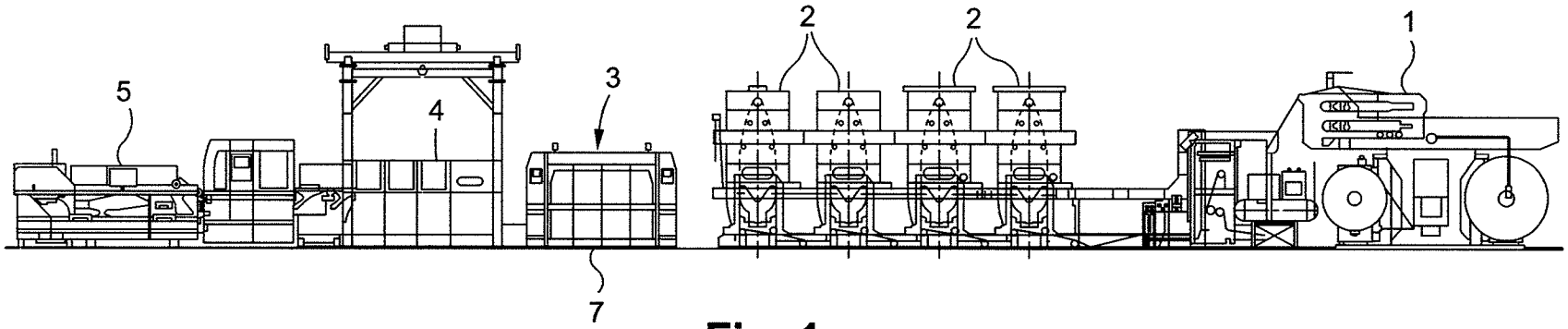
FIG. 1 is an overall view of an example of a conversion line for converting a flat substrate.

A conversion line for converting a flat substrate, such as a flat cardboard or a continuous web of paper wound on a reel, makes it possible to carry out various operations and obtain packaging such as folding boxes. As shown in FIG. 1, the conversion line comprises, disposed one after another in the order of passage of the flat substrate, an unwinding station 1, several printer units 2, one or more embossing units in series followed by one or more scoring units in series 3, followed by a rotary cutting unit 4 or platen die-cutting unit, and a station 5 for receiving the manufactured objects.

The conversion unit 7 comprises an upper rotary tool 10 and a lower rotary tool 11, which modify the flat substrate by printing, embossing, scoring, cutting, ejection of scrap, etc., in order to obtain packaging.

The rotary tools 10 and 11 are mounted parallel to one another in the conversion unit 7, one above the other, and extend in the transverse direction T, which is also the direction of the axes of rotation A1 and A2 of the rotary tools 10 and 11 (see FIG. 2). The rear ends 10*b* and 11*b* of the rotary tools 10 and 11, on the opposite side from the driver, are driven and rotated by motorized drive means (not shown).

In operation, the rotary tools 10 and 11 rotate in opposite directions about respective axes of rotation A1 and A2 (arrows Fs and Fi in FIG. 2). The flat substrate passes through the gap situated between the rotary tools 10 and 11 in order to be embossed and/or scored and/or cut and/or printed on therein.

Each rotary tool, the upper rotary tool 10 or the lower rotary tool 11, comprises a mandrel 12 and a removable sleeve 13 that is able to be fitted on the mandrel 12 in the transverse direction T (FIG. 2, arrow G). Thus, when changing the rotary tools 10 and 11 is desired, all that is necessary is to change the sleeves 13 rather than the entire rotary tool 10 and 11. Since it is easier to handle the sleeve 13 on account of its low weight relative to that of the entire rotary tool 10 and 11, the change of operation can be effected rapidly. Moreover, the sleeves 13 are inexpensive compared with the price of the rotary tool 10 and 11 as a whole. It is thus advantageous to use one and the same mandrel 12 in combination with several sleeves 13 rather than to acquire several entire rotary tools 10 and 11.

The sleeve 13 has a cylindrical overall shape. The mandrel 12 and the sleeve 13 are made of a metal material, with the mandrel 12 being made, for example, of steel and the sleeve 13 of aluminum. The front and rear ends 10*a*, 11*a*, 10*b*, 11*b* of the mandrels 12 (or trunnions) form the ends of the rotary tools 10 and 11 that are intended to engage with the front and rear bearings of the conversion unit 7.

The front and rear bearings are each carried by a tool-holder column arranged at the front of the framework, also known as turret 16, and a tool-holder column arranged at the rear of the framework. The turret 16 extends vertically and has the shape of a frame with a central passage for the rotary tools 10 and 11.

Once mounted in the conversion unit 7, the rotary tools 10 and 11 are parallel to one another. The rotary tools 10 and 11 are one above the other and extend in the transverse direction T, which is also the direction of the axes of rotation A1 and A2 of the rotary tools 10 and 11 (see FIG. 2).

A transport carriage 20 (FIGS. 3 to 5) is provided for mounting or removing the mandrel 12 or entire rotary tool 10 and 11 in or from the conversion unit 7 and for the transport thereof.

The transport carriage 20 comprises a tool-holder head 21 and a mobile base 22. The mobile base 22 comprises a body 23 that is terminated by a leg 24 provided with rolling elements 25. The leg 24 extends in the forward direction of the transport carriage 20. The rolling elements 25 are, for example, wheels, the rear wheels being pivot mounted, for example. The body 23 also comprises a gripping means 28, arranged at the rear for pushing, pulling, or manually guiding the movement of the transport carriage 20 in the factory.

The tool-holder head 21 is provided with an upper port 29 and a lower port 30 that are each intended to receive a tool end 12. The tool end is either that of a mandrel 12 on its own or that of a mandrel 12 provided with a sleeve 13, that is to say that of an entire rotary tool 10 and 11, or that of a one-piece tool.

The upper and lower ports 29 and 30 of the tool-holder head 21 are identical. They are arranged one above the other. Once mounted in the tool-holder head 21, the mandrels 12 or rotary tools 10 and 11 extend in parallel and are kept spaced apart at a predetermined spacing. They protrude from the tool-holder head 21 in the forward direction of the transport carriage 20.

The tool-holder head 21 thus makes it possible to arrange the rotary tools 10 and 11 such that they can easily be mounted in/removed from the conversion unit 7. The parallel arrangement of the mandrels 12 or the rotary tools 10, 11 at a predetermined spacing in the transport carriage 20 allows them to be transferred without additional manipulations of the rotary tools 10 and 11 already prepositioned in the region of the bearings of the conversion unit 7. The risks of collision between the rotary tools 10 and 11 are thus reduced, but also between the rotary tools 10 and 11 and the conversion unit 7. The positioning of the rotary tools 10 and 11 along the axis of the bearings of the conversion unit 7 is also rendered easier. Furthermore, the number of operations is reduced and the handling of the heavy rotary tools 10 and 11 is rendered easier.

In order to dock the tool-holder head 21 with the conversion unit 7, the tool-holder head 21 can comprise a front holding interface that is intended to engage with the turret 16 of the conversion unit 7 in order to fix the tool-holder head 21 to the turret 16. The fixing of the transport carriage 20 to the conversion unit 7 makes it possible for the conversion unit 7 to reference the precise position of the mandrel 12 or of the tool.

According to an exemplary embodiment shown in FIGS. 3 to 11, the front holding interface is configured to hang the tool-holder head 21 on the turret 16 of the conversion unit 7. The fixing of the tool-holder head 21 on the turret 16 by hanging is easy to carry out and can also be entirely automated, notably by virtue of the use of a lifting device of the transport carriage 20 that is configured to raise (FIGS. 3 and 4) or lower (FIG. 5) the tool-holder head 21 with respect to the leg 24.

According to one exemplary embodiment, the lifting device comprises an actuator, such as a hydraulic actuator 31 that is able to be actuated by a lever 32. The lifting device can also comprise two guide rails 33, arranged vertically in the body 23 of the mobile base 22, on either side of the tool-holder head 21, for guiding the vertical movement of the tool-holder head 21 along the body 23.

The lifting device thus makes it possible to lift and lower significant loads such as the rotary tool elements 10 and 11 for hanging the tool-holder head 21 on the turret 16 of the conversion unit 7 but also makes it possible to make the handling of the transport carriage 20 in the factory safer by lowering the center of gravity of the load. Specifically, the lowering of loads while the rotary tools 10 and 11 are being conveyed in the factory makes it possible to avoid a situation in which the transport carriage 20 is unbalanced by the cantilevered rotary tools 10 and 11.

In order to hang the tool-holder head 21 on the turret 16 of the conversion unit 7, the front holding interface comprises, for example, at least one first attachment member that is intended to engage with at least one complementary first attachment member of the turret 16.

More specifically, the first attachment members comprise, for example, at least one first hook 34 that is able to engage with a first roller 35 mounted so as to rotate freely on the turret 16. The rollers 35 make it easier to mount the tool-holder head 21 on and remove it from the turret 16, limiting the risks of jamming.

The first hooks 34 are carried by the tool-holder head 21 and the rollers 35 by the turret 16, or vice versa. As can be seen more clearly in FIGS. 6 and 7, the tool-holder head 21 comprises, for example, four first hooks 34. The first hooks 34 are inscribed in a rectangle formed around the upper and lower ports 29 and 30 of the tool-holder head 21. The rollers 35 protrude longitudinally.

The first attachment members allow the tool-holder head 21 to be guided up to and fixed on the conversion unit 7, notably by avoiding movements of the tool-holder head 21 in the transverse direction, along the axis of rotation of the rotary tools 10 and 11.

Figure 6:
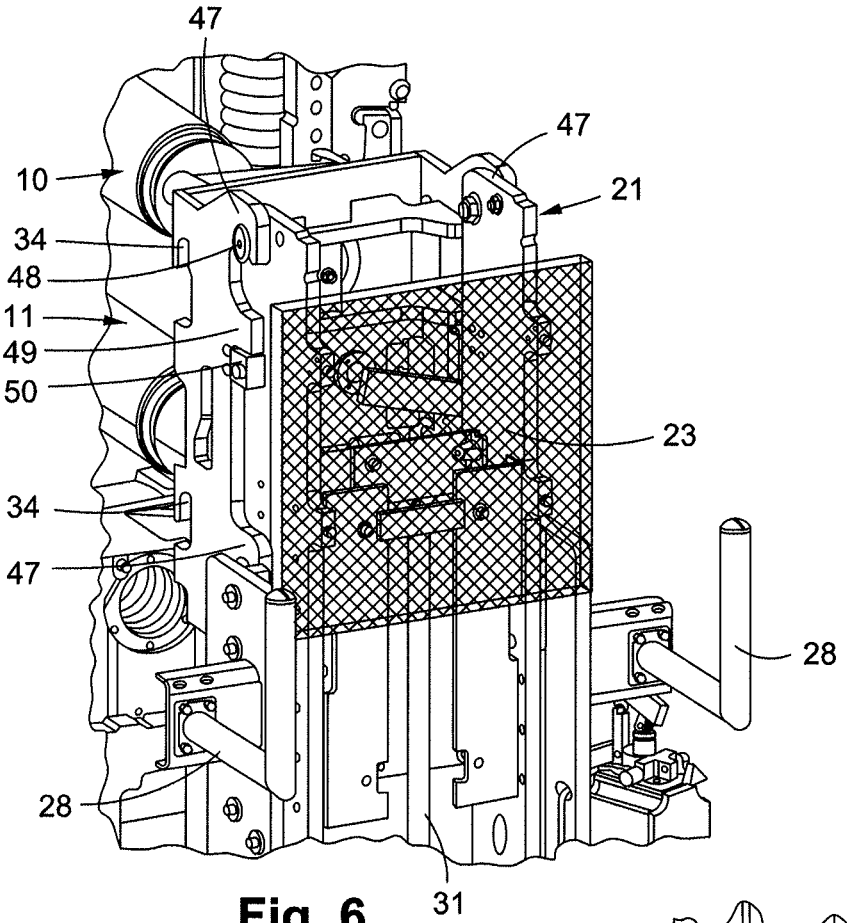
FIG. 6 shows a partial view of the transport carriage from FIG. 3 fixed to the turret of a conversion unit.
Figure 7:
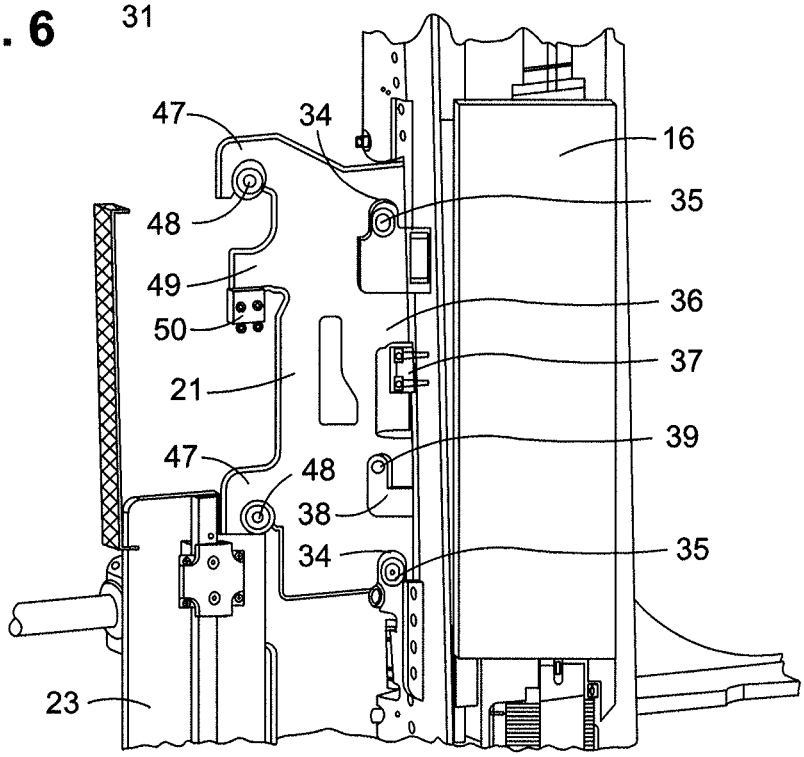
FIG. 7 is a vertical cross-sectional view of the transport carriage fixed to the turret, illustrating first and second attachment members of the tool-holder head.

The front holding interface can also comprise at least one first shoulder 36 that is intended to engage with a support block 37 fixed to the turret 16 for carrying the tool-holder head 21 (FIGS. 6 and 7).

The front holding interface comprises, for example, two first shoulders 36. The first shoulder 36 is formed, for example, in a recess. Each first shoulder 36 is arranged, for example, between two first hooks 34. Each first shoulder 36 and two first hooks 34 of the first attachment members are aligned, for example, vertically and can be produced in the edge of one and the same plate of the tool-holder head 21, for example, by cutting.

When the tool-holder head 21 is carried by the support blocks 37 of the turret 16, the first hooks 34 are disposed substantially above the first rollers 35. This makes it possible for the tool-holder head 21 not to rest on the first rollers 35 but for most of the weight of the rotary tools 10 and 11 to be absorbed by the support blocks 37 of the turret 16. The support blocks 37 thus make it possible to relieve the first rollers 35 of the weight of the rotary tools 10 and 11 that are substantially more fragile. The support blocks 37, fixed to the turret 16, form the vertical reference.

Moreover, the front holding interface can comprise at least one guide slot 38 that is intended to engage with a complementary guide pin 39 carried by the turret 16. Two guide slots 38 can be provided, for example, which are aligned vertically with the first attachment members, between the latter, and on either side of the upper and lower ports 29 and 30.

The guide slot 38 is L-shaped with a smaller thickness than the openings of the first hooks 34 of the first guide members and than the recesses of the first shoulders 36, so as to guide the docking of the tool-holder head 21 on the turret 16. The guide pin 39, which is more robust than the rollers 35, therefore allows the tool-holder head 21 to be guided in the direction along the axis of rotation of the rotary tools 10 and 11 and then vertically, following the L-shaped path of the guide slots 38, avoiding possible collisions between the hooks of the tool-holder head and the rollers 35 of the turret 16.

The guide slot 38 is arranged, for example, between the first shoulder 36 and a first hook 34 of the first attachment members. The guide slot 38, the first shoulder 36 and the first hooks 34 are aligned, for example, vertically and produced in the edge of one and the same plate of the tool-holder head 21.

The tool-holder head 21 can furthermore comprise a locking device configured to take up an unlocked position (FIG. 9) or a locking position (FIG. 8) in which the locking device locks the holding of the front ends of the mandrels 12 or the tools 10 and 11 in the upper and lower ports 29 and 30.

Figure 9:
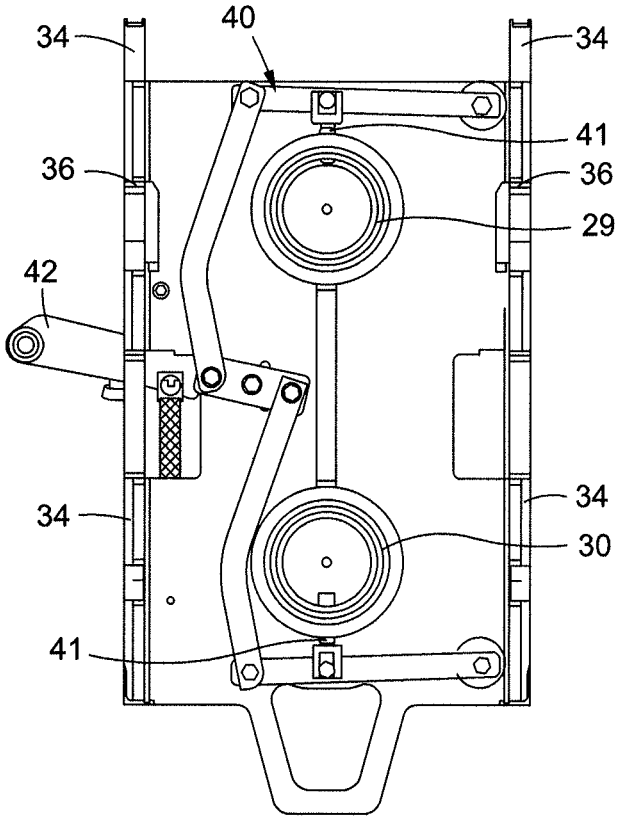
FIG. 9 shows a view similar to FIG. 8 in the unlocked position.
Figure 10:
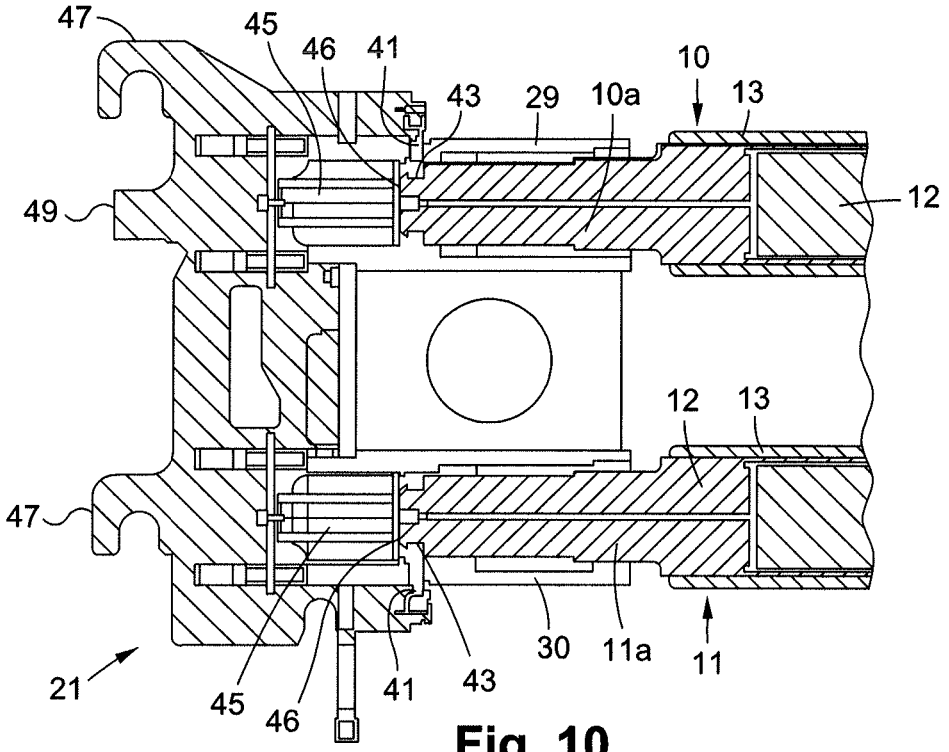
FIG. 10 shows a cross-sectional view of elements of a transport head provided with rotary tools.

For example, the locking device comprises an articulated system 40, two locking pins 41 and an actuating lever 42. The actuating lever 42 is connected to the upper and lower locking pins 41 by the articulated system 40 such that the actuation of the lever 42 positions the locking pins 41 in the unlocked position, in which the locking pins 41 are retracted into the upper and lower ports 29 and 30, away from the rotary tools 10 and 11 (FIG. 9), or in the locking position, in which the locking pins 41 pass through the upper and lower ports 29 and 30 and are inserted into corresponding cavities 43 formed in the front ends of the rotary tools 10 and 11 (FIG. 10).

Figure 11:
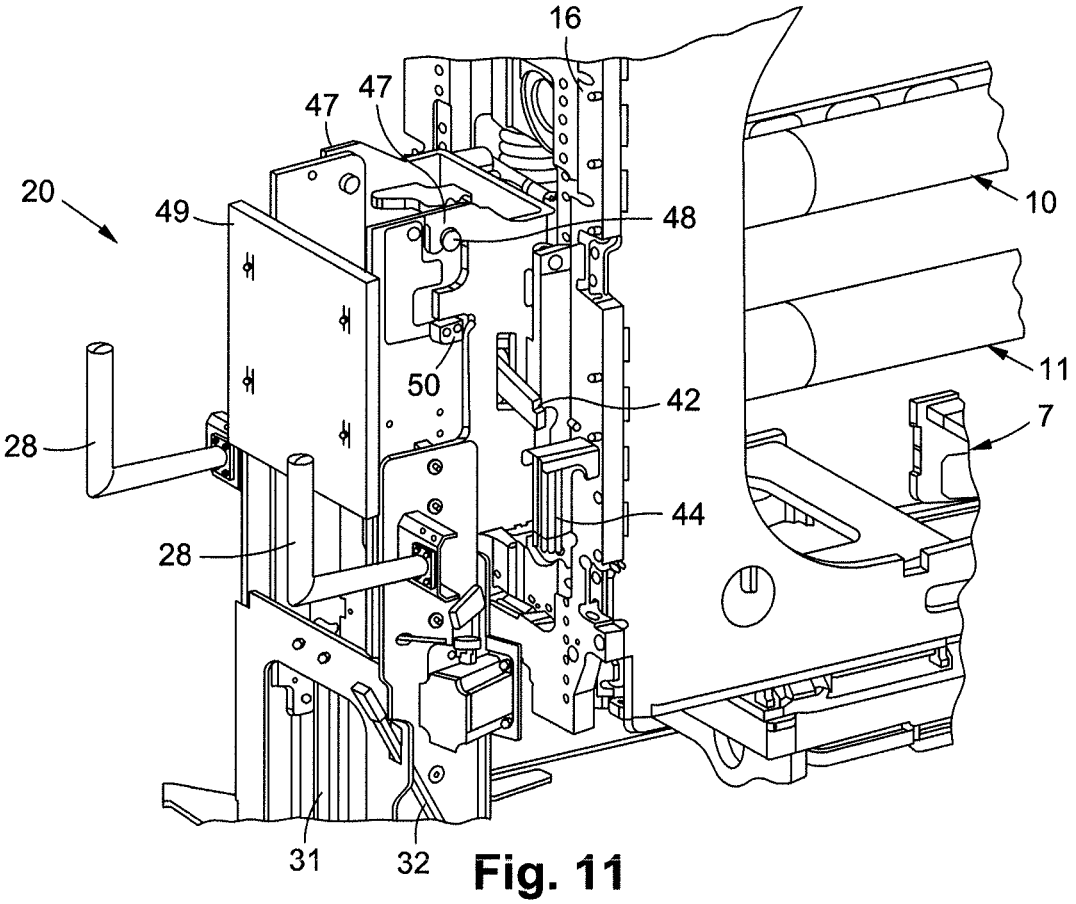
FIG. 11 shows a perspective view of the transport carriage from FIG. 3 fixed to the turret of a conversion unit.

More specifically, the articulated system 40 comprises, for example, two articulated arms at the end of the actuating lever 42, said end being at the opposite end from an end connected to an actuator 44, such as a pneumatic cylinder of the locking device (FIG. 11). Each arm is articulated such that, for example, when the lever 42 is in the lowered position (FIG. 8), the locking pins 41 are inserted into the cavities 43 of the rotary tools 10 and 11. The pivoting upward of the actuating lever 42 (arrow F1) offsets the upper arm upward (arrow F2), withdrawing the locking pin 41 from the cavity 43 of the upper rotary tool 10, and offsets the lower arm downward (arrow F3), withdrawing the locking pin 41 from the cavity 43 of the lower rotary tool 11.

The locking device can also comprise end of travel sensors for automating the locking and unlocking of the holding of the end of the mandrel 12 or of the tool 10 and 11, and also for better synchronizing the succession of operations, reducing the risk of collision.

The upper and lower ports 29 and 30 can also each be provided with a resilient device, such as a thrust spring 45 that is intended to bear against the end of the mandrel 12 or of the tool, for example, via a washer 46 in abutment against the end wall of the bore of the ports 29 and 30. The resilient device is arranged so as to be able to be pushed back by the mandrel 12 or the tool to the end wall of the housing of the upper or lower port 29 and 30 (FIG. 10). Collisions of the mandrel 12 or of the tool 10 and 11 are thus avoided with the tool-holder head 21 in the unlocked position by manipulation of the mandrel 12 or of the tool 10 and 11 at the rear end by the gripper of the motorized drive means, on the opposite side from the driver.

The tool-holder head 21 can be provided in a removable manner to be detachable from the mobile base 22 of the transport carriage 20. Thus, the mobile base 22 can be the same for different heads, such as sleeve-holder heads and/or tool-holder heads of different diameters.

In order to hang the tool-holder head 21 on the mobile base 22 of the transport carriage 20, the tool-holder head comprises, for example, a rear holding interface that is intended to engage with the mobile base 22 and comprises at least one second attachment member intended to engage with at least one complementary second attachment member of the mobile base 22.

More specifically, the second attachment members comprise at least one second hook 47 that is able to engage with a second roller 48 mounted so as to rotate freely on the mobile base 22. The rollers 48 make it easier to mount the tool-holder head 21 on and remove it from the mobile base 22, limiting the risks of jamming.

The second hooks 47 are carried by the tool-holder head 21 and the rollers 48 by the mobile base 22, or vice versa. As can be seen more clearly in FIGS. 4 and 6, the tool-holder head 21 comprises, for example, four second hooks 47. The four second hooks 47 are inscribed in a rectangle formed around the upper and lower ports 29 and 30 of the tool-holder head 21, for example, behind the four first hooks 34 of the first attachment members. The second rollers 48 protrude longitudinally. The second attachment members allow the tool-holder head 21 to be guided up to and fixed on the mobile base 22.

Figure 4:
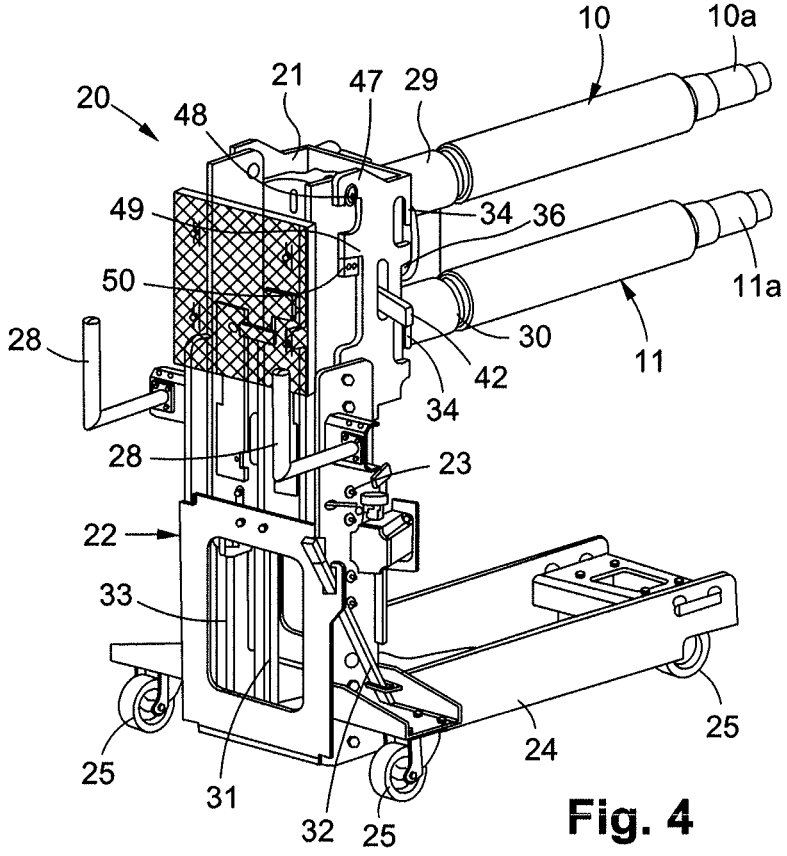
FIG. 4 shows a rear view of the transport carriage from FIG. 3.
Figure 5:
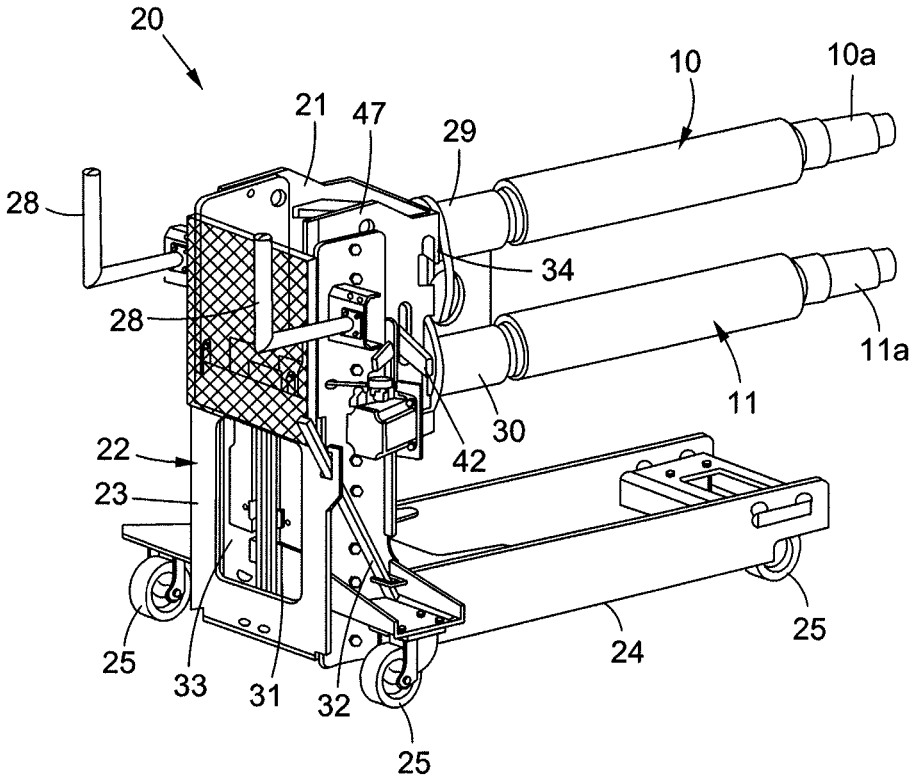
FIG. 5 shows the transport carriage from FIG. 3 in the lowered position.

The rear holding interface can also comprise at least one second shoulder 49 that is intended to engage with a support block 50 fixed to the mobile base 22 for carrying the tool-holder head 21 (FIGS. 4 and 6).

The rear holding interface comprises, for example, two second shoulders 49. The second shoulder 49 is formed, for example, in a recess. Each second shoulder 49 is arranged, for example, between two second hooks 47. Each second shoulder 49 and two second hooks 47 of the second attachment members are aligned, for example, vertically and can be produced in the edge of one and the same plate of the tool-holder head 21, for example, by cutting.

When the tool-holder head 21 is carried by the support blocks 50 of the mobile base 22, the second hooks 47 are disposed substantially above the second rollers 48. This makes it possible for the tool-holder head 21 not to rest on the second rollers 48 but for most of the weight of the rotary tools 10 and 11 to be absorbed by the support blocks 50 of the mobile base 22. The support blocks 50 thus make it possible to relieve the second rollers 48 of the weight of the rotary tools 10 and 11 that are substantially more fragile.

The operator wishes to mount the rotary tools in a conversion unit 7. For this purpose, the operator provides a tool-holder head 21 with mandrels 12 or rotary tools 10 and 11 by inserting the front ends thereof into the housings of the upper and lower ports 29 and 30. Next, the holding of the front ends of the mandrels 12 or of the tools in the upper and lower ports 29 and 30 is locked (FIG. 8) and the tool-holder head 21 provided with mandrels 12 or rotary tools 10 and 11 is hung on the mobile base 22 of the transport carriage 20.

Figure 3:
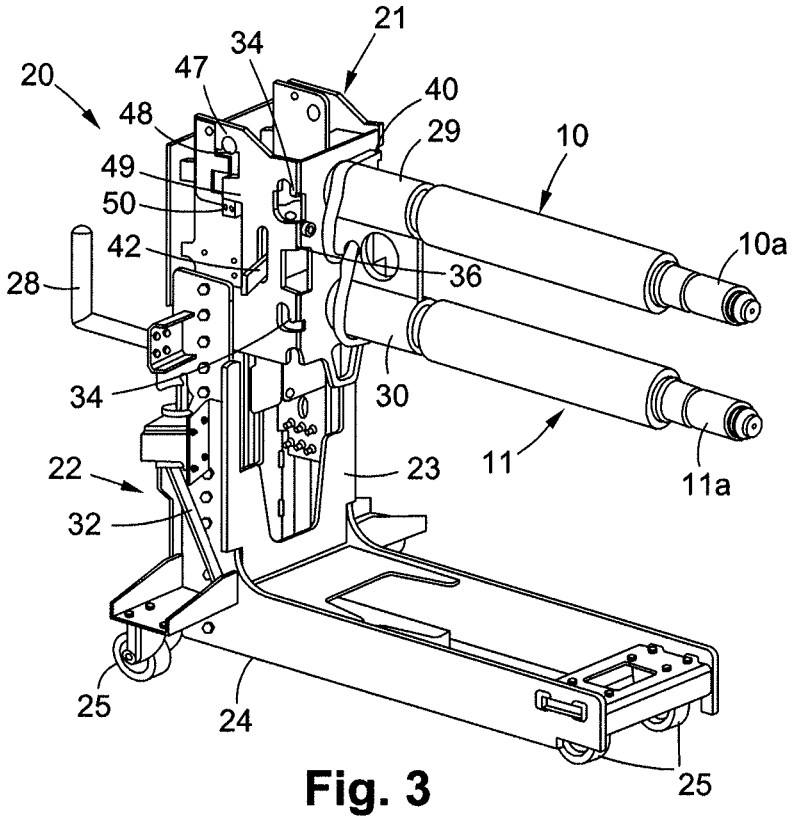
FIG. 3 shows a perspective view of a transport carriage carrying two rotary tools in the raised position.

The transport carriage 20 transports the rotary tools 10 and 11 in a lowered position toward the conversion unit 7 (FIG. 5) where it lifts the tool-holder head 21 and the rotary tools 10 and 11 into a raised position by way of the lifting device (FIGS. 3 and 4).

The tool-holder head 21 is thus raised such that the guide pin 39 is inserted into the guide slot 38, the support blocks 37 are fitted under the first shoulders 36 and the first rollers 35 are inserted into the openings of the first hooks 34. Next, the operator moves the transport carriage 20 substantially forward until the guide pin 39 is at the end of the horizontal part of the guide slot 38. The transport carriage 20 thus substantially lowers the tool-holder head 21 such that the tool-holder head 21 is hung on the holding blocks 50 of the turret 16, the guide pin 39 is received at the end of the top part of the guide slot 38 and the first hooks 34 are arranged substantially above the first rollers 35. The tool-holder head 21 of the transport carriage 20, provided with mandrels 12 or tools 10 and 11, is thus fixed to the turret 16 (FIGS. 6 and 7).

The grippers of the motorized drive means on the opposite side from the driver then engage with the rear ends of the mandrels 12 or of the tools 10 and 11, locking the holding of the rear ends of the mandrels or of the tools by the conversion unit 7.

The holding of the front ends of the tools is then unlocked by the transport carriage 20. The resilient device then allows the mandrel 12 or the tool to be moved substantially by the gripper in the upper or lower ports 29 and 30, avoiding collisions (FIG. 9). The resilient device ensures contact with the end side of the gripper.

In order to remove the tools from the conversion unit 7, the operator starts by fixing the tool-holder head 21, not provided with a tool, of the transport carriage 20 to the turret 16. Next the operator unlocks.

Figure 8:
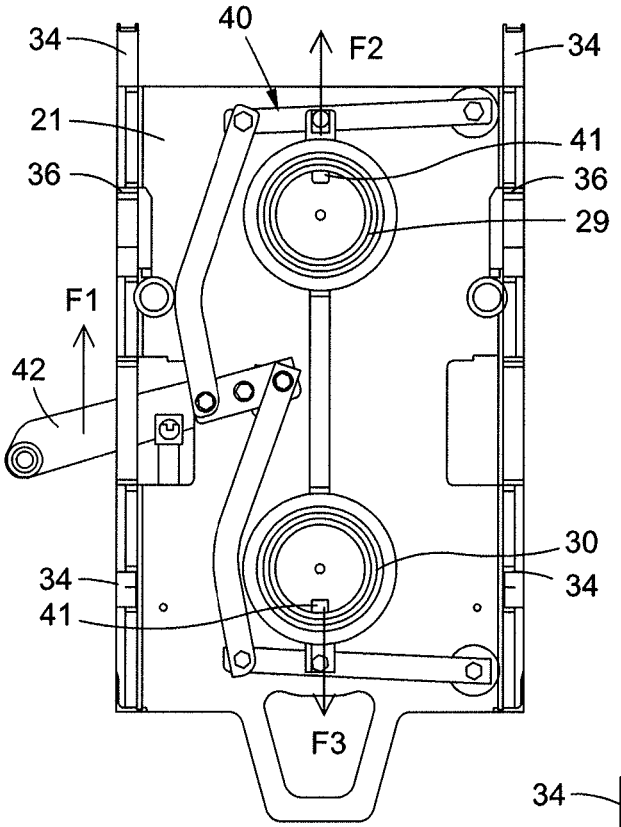
FIG. 8 shows a front view of the tool-holder head in the locking position.

Next, the front ends of the mandrels 12 or of the tools 10 and 11 are fitted in the upper and lower ports 29 and 30 of the tool-holder head 21 fixed to the turret 16. Next, the operator locks the holding of the front ends of the mandrels 12 or of the tools 10 and 11 by the transport carriage 20 and the operator unlocks the holding of the rear ends of the mandrels 12 or of the tools 10 and 11 by the conversion unit 7 (FIG. 8).

The moving of the rotary tools 10 and 11 toward or away from the conversion units 7 is rendered easier, since they can be changed rapidly, in a reproducible and simple manner.

The present invention is not limited to the embodiments described and illustrated. Numerous modifications can be made without otherwise departing from the scope defined by the set of claims.

The invention claimed is:

1. A tool-holder head for a carriage for transporting rotary tools of a unit for converting a flat substrate, the tool-holder head comprising:

a lower port, and an upper port arranged above the lower port;

the upper port and the lower port are configured to receive, respectively, a front end of an upper rotary tool and a front end of a lower rotary tool such that when received the upper and lower rotary tools extend in parallel and spaced apart at a predetermined spacing from each other;

a front holding interface comprising at least one first attachment member configured to engage with a complimentary engagement member of a turret of the unit for converting so as to hang the tool-holder head on the turret in order to fix the tool-holder head to the turret; and a rear holding interface configured to engage with a mobile base of the carriage so as to fix the tool-holder head to the mobile base.

2. The head according to claim 1, wherein the front holding interface is configured to hang the tool-holder head on the turret of the conversion unit.

3. The head according to claim 2, wherein the at least one first attachment member comprises at least one first hook that is configured to engage with a first roller mounted so as to rotate freely.

4. The head according to claim 3, wherein the front holding interface comprises at least one first shoulder configured to engage with a support block of the turret for carrying the tool-holder head, such that when the tool-holder head is carried by the support block, the first hooks is disposed substantially above the first rollers.

5. The head according to claim 4, wherein the front holding interface comprises:

at least one guide slot configured to engage with a complementary guide pin carried by the turret, wherein the guide slot is L-shaped with a smaller thickness than the openings of the first hooks.

6. The head according to claim 1, wherein the rear holding interface is configured to hang the tool-holder head on the mobile base.

7. The head according to claim 6, wherein the rear holding interface comprises at least one second attachment member that is configured to engage with at least one complementary second attachment member of the turret, the second attachment member comprising at least one second hook configured to engage with a second roller mounted so as to rotate freely.

8. The head according to claim 7, wherein the rear holding interface comprises at least one second shoulder that is configured to engage with a support block of the mobile base for carrying the tool-holder head, such that when the tool-holder head is carried by the support block, the second hooks are disposed substantially above the second rollers.

9. The head according to claim 1, further comprising a locking device configured to take up an unlocked position or a locking position in which the locking device locks the holding of one end of the tool in the port.

10. The head according to claim 9, wherein the locking device comprises:

an articulated system, an upper locking pin, a lower locking pin, and an actuating lever that is connected to the upper and lower locking pins by the articulated system such that actuation of the actuating lever positions the locking pins in the unlocked position or the locking position.

11. The head according to claim 1, wherein the port comprises a respective resilient device configured to bear against the end of the tool and is configured to be pushed back by the end of the tool toward an end wall of the housing of the port.

12. A transport carriage comprising: a leg provided with rolling elements, a tool-holder head according to claim 1, and a lifting device configured to raise or lower the tool-holder head with respect to the leg.

* * * * *